United States Patent [19]

Pawelko et al.

[11] 4,237,907

[45] Dec. 9, 1980

[54] APPARATUS FOR CONVOLUTING ADHESIVE-COATED UNITING BANDS AROUND GROUPS OF ROD-SHAPED ARTICLES IN FILTER TIPPING AND LIKE MACHINES

[75] Inventors: Karl-Heinz Pawelko, Marschacht; Erwin Oesterling, Hamburg, both of Fed. Rep. of Germany

[73] Assignee: Hauni-Werke Körber & Co. KG, Hamburg, Fed. Rep. of Germany

[21] Appl. No.: 79,482

[22] Filed: Sep. 27, 1979

[30] Foreign Application Priority Data

Oct. 2, 1978 [DE] Fed. Rep. of Germany ..... 2842834

[51] Int. Cl.[3] ..... A24C 5/32

[52] U.S. Cl. ..... 131/23 A; 131/35; 131/94; 156/389

[58] Field of Search ..... 131/23 A, 27 A, 32, 131/35, 37, 30; 156/389

[56] References Cited

U.S. PATENT DOCUMENTS

| | | | |
|---|---|---|---|
| 1,982,292 | 11/1934 | Granstedt | 131/23 A |
| 2,918,923 | 1/1959 | Morris | 131/231 A |
| 3,077,889 | 2/1963 | Patterson | 131/94 |
| 3,094,128 | 6/1963 | Dearsley | 131/231 A |
| 3,148,683 | 9/1964 | Brown et al. | 156/456 X |

*Primary Examiner*—David A. Simmons
*Attorney, Agent, or Firm*—Peter K. Kontler

[57] ABSTRACT

A filter tipping machine for the production of filter cigarettes has an apparatus which convolutes adhesive-coated uniting bands around groups of coaxial filter plugs and plain cigarettes while the groups move sideways through a gap which is defined by the convex peripheral surface of a drum-shaped first rolling device and the concave surface of a normally stationary second rolling device. If the surfaces of the rolling devices are contaminated or are likely to be contaminated by adhesive which is removed from the uniting bands during their conversion into tubes while the respective groups advance through the gap, the second rolling device is moved away from the first rolling device and a brush is caused to sweep along the two surfaces to remove the accumulations of adhesive. Widening of the gap and movements of the brush along the two surfaces can be initiated in response to signals which are generated by a jam detector at the inlet of the gap, by a switch which starts the motor of the filter tipping machine, by a switch which arrests the motor, and/or by a switch which is actuated by an attendant whenever the attendant feels that a cleaning of the rolling device is in order.

19 Claims, 9 Drawing Figures

Fig.2
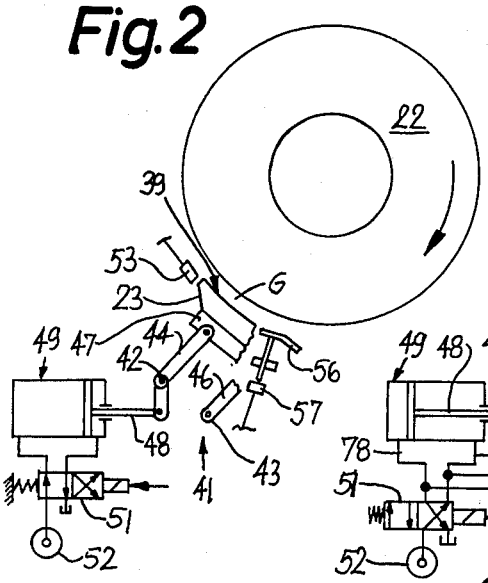
Fig.3
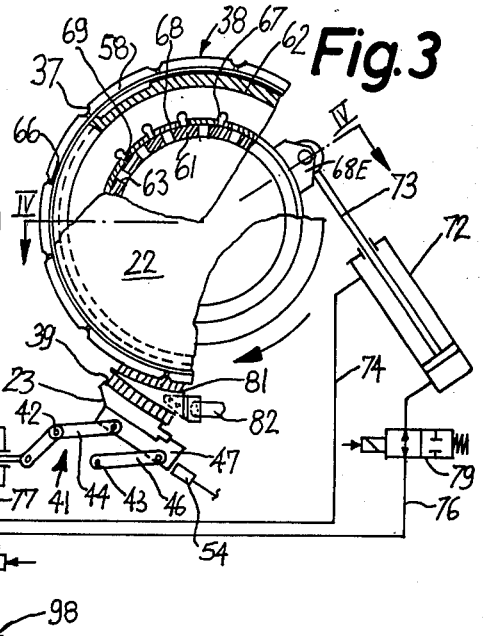
Fig.4
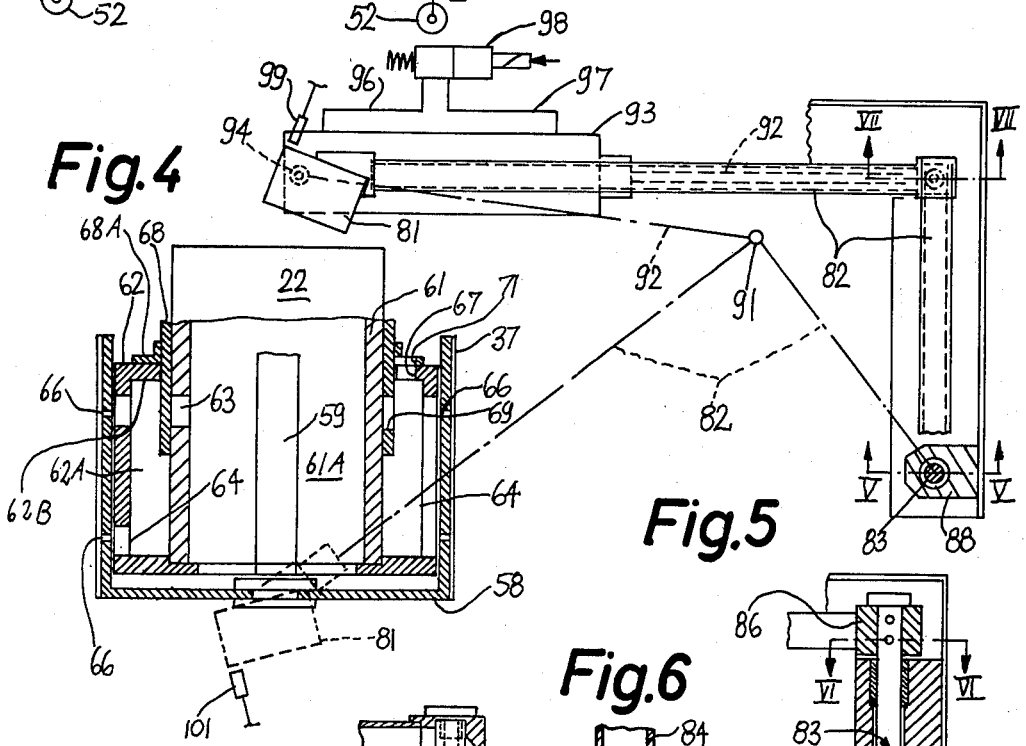
Fig.5
Fig.6
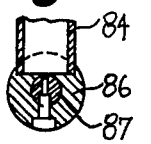
Fig.7
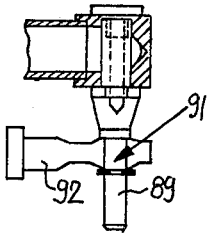

102
103
57
104
107
106
53
54
101
99
116
117
118
119
128
127
121
122
123
148
149
138
139
147
133
136
124
129
142
131
132
143
144
146
126
141
112
108
109
111
113
114
134
137
151
152
01
02
On

APPARATUS FOR CONVOLUTING ADHESIVE-COATED UNITING BANDS AROUND GROUPS OF ROD-SHAPED ARTICLES IN FILTER TIPPING AND LIKE MACHINES

BACKGROUND OF THE INVENTION

The present invention relates to apparatus for connecting rod-shaped articles end-to-end, especially for connecting filter plugs or mouthpieces with plain cigarettes, cigarillos or cigars. More particularly, the invention relates to improvements in apparatus for convoluting adhesive-coated uniting bands around groups of coaxial rod-shaped articles which constitute or form part of smoker's products. Still more particularly, the invention relates to improvements in apparatus of the type wherein adhesive-coated uniting bands are draped around groups of coaxial rod-shaped articles while the articles move sideways through a gap whose width is less than the diameter of a group so that the groups of articles are caused to roll about their respective axes.

It is well known to equip a filter tipping machine with an apparatus which connects filter plugs or mouthpieces with plain cigarettes to form filter cigarettes of unit length or double unit length. Such apparatus normally comprise a first rolling device which is a rotary drum-shaped conveyor, and a second rolling device which is a stationary block or an endless belt. Reference may be had, for example, to commonly owned U.S. Pat. Nos. 3,483,873 and 3,527,234 respectively granted on Dec. 16, 1969 and Sept. 8, 1970 to Alfred Hinzmann. Groups of coaxial filter plugs and plain cigarettes are delivered onto the first rolling device which transports successive groups through a relatively narrow gap between the two rolling devices so that the groups are compelled to rotate about their respective axes. Adhesive-coated uniting bands are attached to successive groups prior to entry into the gap, and the uniting bands are converted into tubes which surround the filter plugs and the adjacent portions of the plain cigarettes as a result of rotation of the groups about their axes. In earlier versions of such apparatus, the first rolling device (conveyor) has several ribs which are parallel to its axis and extend outwardly beyond its peripheral surface. The ribs flank convex fields along which the groups of coaxial articles roll backwards during travel through the aforementioned gap. An advantage of the ribs is that they determine, in advance, the extent of rotation of each group about its axis. In other words, the ribs insure that each group rotates to an extent which suffices to insure satisfactory convolution of uniting bands around the filter plugs and around the adjacent portions of plain cigarettes. When a group emerges from the gap, it lies against one of the ribs and is thereby held in a predetermined position which facilitates its transfer onto the next conveyor, e.g., onto a conveyor whereon the group of united articles is severed midway between its ends to yield two filter cigarettes of unit length. The procedure is quite similar to the manufacture of certain types of filter tipped cigarillos and cigars.

An advantage of the just described earlier apparatus is that their operation is not unduly affected by deposits of adhesive paste on the first and/or second rolling device. In fact, the just described apparatus with ribs at the periphery of the first rolling device produce a certain amount of self-cleaning action so that the intervals of stoppage for the purpose of removing accumulations of adhesive paste are infrequent. Some adhesive is likely to deposit on the surfaces of the two rolling devices because one side of each uniting band is coated with adhesive and the surplus of adhesive is likely to escape beyond the axial ends of the convoluted uniting band during transport of the respective group through the gap between the two rolling devices. Also, some of the surplus of adhesive paste can escape from the seam where the marginal portions of the convoluted uniting band overlap each other.

Recent types of filter tipping machines for the production of filter cigarettes or the like are equipped with modified convoluting apparatus whose versatility exceeds that of the apparatus using a first rolling device which is a conveyor with peripheral ribs. The ribs are spaced apart from each other (as considered in the circumferential direction of the first rolling device) to such an extent that a group which is transferred onto the conveyor and has a given diameter can complete one full revolution about its own axis before it moves into abutment with and is arrested (against further rotation about its axis) by the nearest rib. Thus, if the manufacturer wishes to produce filter cigarettes having larger or smaller diameters, the first rolling device must be replaced with a different rolling device wherein the spacing between neighboring ribs conforms to the diameters of the filter cigarettes to be produced. The aforementioned recent types of convoluting apparatus utilize first rolling devices which constitute or include rotary drum-shaped conveyors with relatively shallow axially parallel peripheral flutes for portions of groups of coaxial rod-shaped articles. The width of the gap between the two rolling devices is such that a group which has entered a shallow flute continues to roll about its own axis and moves out of and beyond the flute. in other words, such apparatus allow for conversion of uniting bands into tubes while the respective groups of coaxial rod-shaped articles complete more than one revolution (e.g., two or three full revolutions) about their respective axes. This enhances the sealing action of convoluted uniting bands and insures that each converted uniting band forms a tube which is a true cylinder of eye-pleasing appearance. Such eye-pleasing appearance and/or airtight connection of filter plugs to neighboring coaxial plain cigarettes is not always insured if the groups are allowed to complete only one revolution about their axes during travel through the aforementioned gap between the two rolling devices. In most instances, a group which is admitted into the gap enters and leaves at least one but normally two shallow grooves before it advances through and beyond the gap.

The just described recent types of convoluting apparatus exhibit a drawback which leads or can lead to frequent interruptions of operation of a filter tipping machine, namely, the surfaces of the two rolling devices are likely to be contaminated by adhesive which is squeezed beyond the marginal portions of uniting bands during their conversion into tubes. This is due to the fact that each group completes several revolutions about its axis during travel through the gap between the two rolling devices. Adhesive paste which accumulates on the first and/or second rolling device is likely to interfere with proper transfer of groups onto the first rolling device, with proper positioning of groups on the first rolling device, with removal of groups from the first rolling device downstream of the gap, and/or with entry of groups into the inlet of the gap. Moreover, adhesive paste which accumulates on the surfaces of the two rolling devices is likely to contaminate the finished products so that the contaminated products must be segregated from satisfactory products. Frequent interruptions of the operation of a modern filter tipping machine are highly undesirable because such machines turn out several thousand filter cigarettes per minute so that losses in output which are attributable to a single stoppage of the filter tipping machine on account of undue accumulation of adhesive on the one and/or the other rolling device can run into tens and hundreds of thousands.

German Pat. No. 823,276 to Körber et al. discloses a machine for the manufacture of filter cigarettes wherein the uniting bands are replaced by sleeves made of hardenable plastic material which is sprayed onto the regions where plain cigarettes abut against filter plugs. Plastic material which deposits on the conveyor means for transport of filter plugs in register with plain cigarettes is caused to pass through a bath which contains a suitable solvent. The action of solvent can be assisted by a brush which is installed in the vessel for the liquid bath. A drawback of such proposal is that the solvent is likely to affect the taste of finished products and also that the conveyor means cannot be driven at a high speed because it must allow for evaporation of solvent before the respective flutes or cradles of the conveyor means receive fresh rod-shaped articles. Furthermore, the wear upon the brush is very pronounced because its bristles are in permanent contact with the moving conveyor means.

U.S. Pat. No. 3,036,581 to Dearsley discloses a cigarette maker wherein a so-called kicker plate carries a bracket for a brush and a finger. The finger and the brush are caused to move through a pair of adjacent spaced nests of rollers on a drum to expel any cigarettes or plug or tobacco material that might have remained in the nested roller holders. The purpose of the brush and/or finger is to expel the constituents of final products, not to scrape off adhesive which accumulates on certain parts owing to the application of excessive amounts of adhesive to uniting bands for cigarettes and filter plugs or like groups of coaxial rod-shaped articles. Moreover, the brush and the finger are in constant use so that they are subjected to extensive wear and must be inspected and replaced at frequent intervals.

U.S. Pat. No. 3,077,889 to Patterson discloses a filter tipping machine wherein deposits of adhesive on a second rolling device cooperating with a first rolling device or conveyor are removed by brushes which are secured to the conveyor and orbit abut the axis of the conveyor while the filter tipping machine is in use. The second rolling device is much longer than necessary and is reciprocated in parallelism with the axis of the conveyor so that it is continuously cleaned by the brushes. Such proposal is satisfactory insofar as the cleaning action upon the concave surface of the second rolling device is concerned. However, the complementary surface of the conveyor is not cleaned at all. Also, the wear upon the brushes is very pronounced because the brushes are used whenever the filter tipping machine is on. Furthermore, movements of the second rolling device in parallelism with the axis of the rolling conveyor while the filter tipping machine is in actual use are likely to affect the accuracy with which the uniting bands are convoluted around plain cigarettes and adjoining filter plugs. The mechanism for reciprocating the second rolling device is complex and expensive.

OBJECTS AND SUMMARY OF THE INVENTION

An object of the invention is to provide a novel and improved apparatus for convoluting adhesive-coated uniting bands around groups of coaxial rod-shaped articles and to provide the apparatus with novel and improved means which can effect rapid, thorough and automatic removal of impurities (particularly deposits of adhesive) from the rolling devices.

Another object of the invention is to provide an apparatus which is equipped with cleaning means and is constructed and assembled in such a way that a cleaning action upon its rolling devices can take place not only when the rolling devices are contaminated but also when such devices are likely to be or are only slightly contaminated.

A further object of the invention is to provide novel and improved cleaning means for use in or with apparatus wherein adhesive-coated uniting bands are convoluted around groups of coaxial filter plugs or mouthpieces and plain cigarettes, cigars or cigarillos.

An additional object of the invention is to provide novel and improved means for controlling the operation of the cleaning means and novel and improved means for preparing the apparatus for the cleaning action.

A further object of the invention is to provide a filter tipping or like machine with an apparatus of the above outlined character and to provide the machine with novel and improved means for initiating the operation of the cleaning means when the need arises, when an attendant so desires and/or when the production of filter tipped smokers' products is interrupted for other reasons so that the cleaning action can be carried out while the machine does not or cannot turn out filter cigarettes, cigarillos or cigars.

Another object of the invention is to provide a relatively simple, compact and inexpensive cleaning device which can be installed in the convoluting apparatus of existing filter tipping or like machines.

A further object of the invention is to provide a convoluting apparatus which can be used in the production of filter cigarettes or like smokers' products having large, medium or small diameters, which requires a minimum of attention, which occupies little room in or on the frame of a filter tipping machine, and whose cleaning implement or implements can stand long periods of use.

Another object of the invention is to provide a convoluting apparatus with cleaning means which contributes to higher output of filter tipping or like machines, to higher quality of final products and to a reduction of the number of rejects.

One feature of the invention resides in the provision of an apparatus for convoluting adhesive-coated uniting bands around groups of coaxial rod-shaped articles in filter tipping and analogous machines, particularly for uniting filter plugs or mouthpieces of double unit length with pairs of plain cigarettes of unit length. The apparatus comprises first and second rolling devices which define a gap having a width which normally at most equals the diameter of a group (i.e., the diameters of articles which form the groups). The first rolling device includes a conveyor and means (e.g., a shaft) for driving the conveyor, and one of the two rolling devices is shiftable with reference to the other rolling device between an operative position in which the two rolling devices define the aforementioned gap and an inoperative position in which the width of the gap is increased. The apparatus further comprises a transfer conveyor or other suitable means for feeding groups of coaxial rod-shaped articles and attached uniting bands into the gap in the operative position of the one rolling device so that the groups are transported through the gap by the conveyor of the first rolling device and are caused to rotate about their respective axes to thereby convert the corresponding uniting bands into tubes. Still further, the apparatus comprises means for shiftng the one rolling device between operative and inoperative positions, and at least one brush or another suitable cleaning implement which is movable between a first position remote from the gap and a second position in the (widened or enlarged) gap to clean at least one of the two rolling devices while the one rolling device is held in the inoperative position.

The apparatus preferably further comprises means for actuating means preferably includes at least one signal generator, e.g., a jam detector which is adjacent to the inlet of the gap and generates or initiates the generation of a "defect" signal when the groups pile up at the inlet to the gap, for example, as a result of excessive accumulation of adhesive paste on the first and/or second rolling device so that the oncoming groups adhere to such rolling device or devices and prevent entry of fresh groups into the gap. The "defect" signal initiates the movement of one rolling device from operative position and the movement of the cleaning implement to its second position, or repeated movements of the cleaning implement between its first and second positions whereby the implement removes adhesive from the one and/or the other rolling device.

The signal generator may constitute the means for starting or arresting the filter tipping machine which embodies the improved apparatus so that the rolling devices are cleaned in automatic response to starting or stoppage of the machine. This constitutes a preventive measure, i.e., cleaning of the rolling devices takes place not because the surfaces of the rolling devices are contaminated with adhesive, dust or the like but solely for the purpose of insuring that a contamination (to the extent which would enable the contaminants to interfere with normal operation of the machine) will not occur or is less likely to occur immediately or shortly after the machine is started again. For the same reason, the machine can be equipped with means for initiating a cleaning action at the will of the operator, e.g., with a switch which can perform the function of the aforediscussed jam detector by initiating the movement of the one rolling device away from the other rolling device and the movement of the brush or brushes into cleaning or contaminats-removing engagement with one or more surfaces of the first and/or second rolling device.

The novel features which are considered as characteristic of the invention are set forth in particular in the appended claims. The improved apparatus itself, however, both as to its construction and its mode of operationg, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged end elevational view of the two rolling devices in the improved convoluting apparatus and of means for shifting one of the rolling devices relative to the other rolling device, the one rolling device being shown in the operative position;

FIG. 3 is a similar end elevational view but showing the other rolling device in partial section and the one rolling device in the inoperative position, and further showing the cleaning implement and the means for moving the cleaning implement relative to the rolling devices;

FIG. 4 is an enlarged sectional view as seen in the direction of arrows from the line IV—IV of FIG. 3, and further showing additional details of means for moving the cleaning implement;

FIG. 5 is an enlarged fragmentary sectional view as seen in the direction of arrows from the line V—V of FIG. 4;

FIG. 6 is a sectional view as seen in the direction of arrows from the line VI—VI of FIG. 5;

FIG. 7 is a sectional view as seen in the direction of arrows from the line VII–VII of FIG. 4;

DESCRIPTION OF THE PREFERRED EMBODIMENTS

Figure 1:
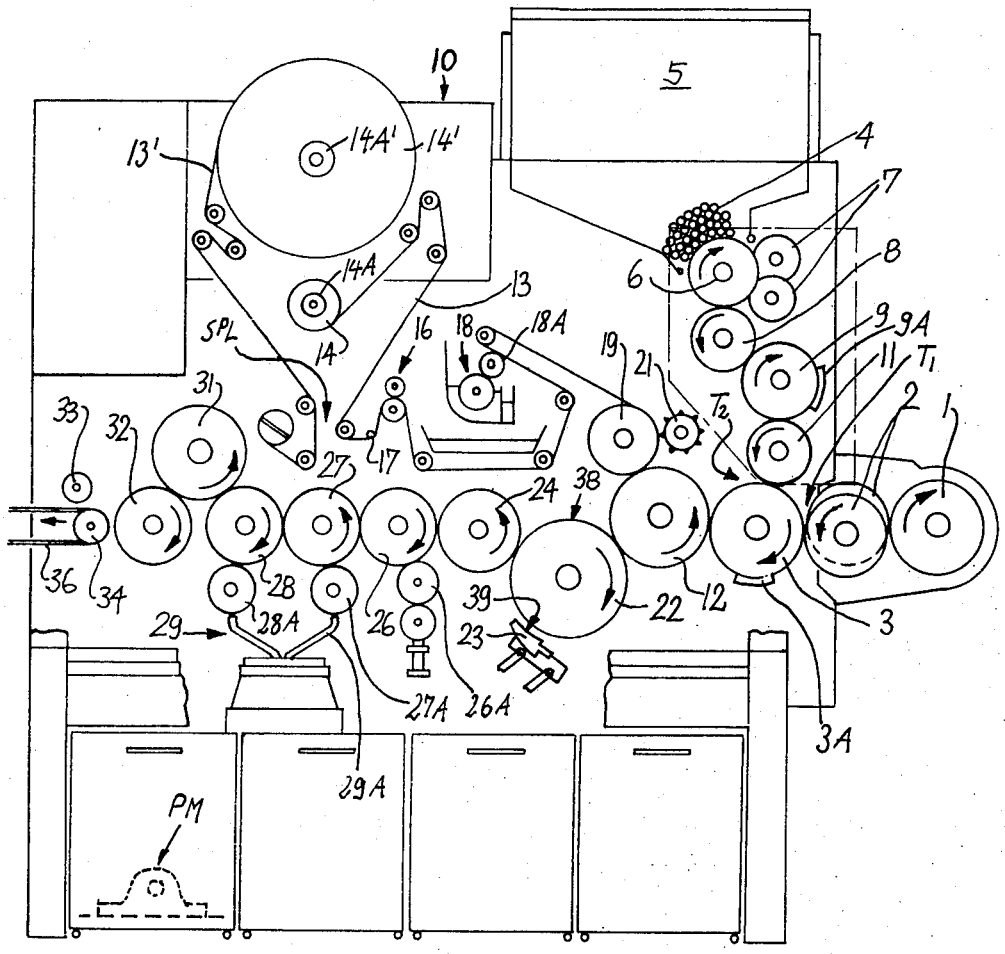
FIG. 1 is a schematic front elevational view of a filter tipping machine embodying a convoluting apparatus which is constructed and assembled in accordance with the present invention.
Figure 9:
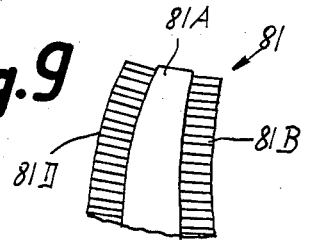
FIG. 9 is a fragmentary end elevational view of a cleaning implement which can be used in the convoluting apparatus.

FIG. 1 shows a filter tipping machine of the type known as MAX S which is produced by the assignee of the present application. This machine is directly coupled with a cigarette making machine (e.g., a machine of the type known as GARANT, also manufactured by the assignee of the present application) which includes a rotary drum-shaped row forming conveyor 1 having peripheral flutes and serving to accummulate and move sideways two rows of plain cigarettes of unit length. The cigarettes of one row are nearer to one axial end of the conveyor 1 and are disposed in the oddly numbered flutes, and the cigarettes of the other row are nearer to the other axial end of the conveyor 1 and are located in the evenly numbered flutes.

The conveyor 1 is rotatably mounted in the frame 10 of the filter tipping machine and delivers the two rows of plain cigarettes to two discrete rotary drum-shaped aligning conveyors 2 which are driven at different speeds and/or transport the plain cigarettes of the respective rows through different distances so that they deliver pairs of coaxial plain cigarettes into successive flutes of a rotary drum-shaped assembly conveyor 3. The transfer station where the aligning conveyors 2 deliver pairs of coaxial plain cigarettes into successive flutes of the assembly conveyor 3 is shown at T1. The plain cigarettes of the two rows are preferably spaced apart from each other, as considered in the axial direction of the conveyors 1, 2 and 3. The width of clearances between the cigarettes of pairs of plain cigarettes in the flutes of the assembly conveyor 3 at least matches the length of a filter plug of double unit length.

The upper portion of the frame 10 carries a magazine 5 for a supply of parallel filter rod sections 4 of six times unit length. The outlet of the magazine 5 receives a portion of a rotary drum-shaped severing conveyor 6 whose peripheral flutes remove discrete filter rod sections 4 and transport them past two rotary disk-shaped knives 7 so that each section 4 yields three coaxial filter plugs or mouthpieces of double unit length. The knives 7 are staggered with respect to each other, as considered in the axial and circumferential directions of the severing conveyor 6. The latter delivers sets of three coaxial filter plugs each into the peripheral flutes of three discrete disks which together constitute a staggering conveyor 8. The disks of the conveyor 8 shift the respective filter plugs in the circumferential direction of the illustrated disk so that each set of three coaxial filter plugs is converted into a staggered set wherein the three filter plugs are disposed one behind the other. The disks of the staggering conveyor 8 deliver filter plugs into successive flutes of a rotary drum-shaped shuffling conveyor 9 which moves the filter plugs through the space between two stationary cams 9A so as to convert the staggered filter plugs into a single row wherein each preceding filter plug is in exact alinement with the next-following filter plug.

Successive filter plugs of the thus obtained orderly row are transferred into the peripheral flutes of a rotary drum-shaped accelerating conveyor 11 which delivers the filter plugs into successive flutes of the assembly conveyor 3 at a second transfer station T2 located ahead of the station T1, as considered in the direction of rotation of the conveyor 3. The conveyor 11 inserts successive filter plugs in such a way that, when a filter plug reaches and advances beyond the transfer station T1, it is located between two coaxial plain cigarettes of unit length. The thus obtained groups of three coaxial rod-shaped articles each (namely, a filter plug of double unit length and two plain cigarettes of unit length) are advanced between two stationary condensing cams 3A which move the plain cigarettes axially toward and into abutment with the respective ends of the associated filter plug. The condensed groups are delivered into the peripheral flutes of a feeding device here shown as a rotary drum-shaped transfer conveyor 12.

The frame 10 also supports a reel 14 for a supply of convoluted wrapping material which constitutes an elongated web 13 consisting of cigarette paper, imitation cork or the like. The means for drawing the web 13 off the reel 14 comprises two advancing rolls 16 at least one of which is driven to move the web 13 past the relatively sharp edge of a curling device 17 whose purpose is to eliminate or equalize the internal stresses in the web 13. A curling device which can be used in the filter tipping machine of FIG. 1 is disclosed in commonly owned U.S. Pat. No. 3,962,957 granted June 15, 1976 to Alfred Hinzmann. The reel 14 is mounted on a spindle 14A which is installed in or on the frame 10. A second spindle 14A' carries a fresh reel 14' containing a supply of convoluted wrapping material which forms a second or fresh web 13'. The leader of the fresh web 13' is held in a position of readiness at a splicing station SPL so that is can be attached to the running web 13 as soon as the diameter of the expiring reel 14 is reduced to a predetermined value. A splicing device which can be installed at the station SPL to automatically or semiautomatically attach the leader of the web 13' to the running web 13 when the supply of web 13 constituting the reel 14 is nearly exhausted is disclosed in commonly owned U.S. Pat. No. 3,730,811 granted May 1, 1973 to Gerd-Joachim Wendt.

The leader of the running web 13 adheres to the foraminous peripheral surface of a rotary suction drum 19 which draws the web 13 past a roller-shaped applicator 18A forming part of a paster 18 which coats one side of the web 13 with a suitable adhesive. The adhesive can coat selected portions of or the entire one side of the web 13. The suction drum 19 cooperates with the knives of a rotary cutting drum 21 which severs the leader of the web 13 at regular intervals so that the web 13 yields a succcession of adhesive-coated uniting bands serving to sealingly connect filter plugs of double unit length to the respective pairs of plain cigarettes, i.e., to convert each group into a filter cigarette of double unit length.

The suction drum 19 rotates at a peripheral speed which slightly exceeds the speed of lengthwise movement of the web 13 under the action of the advancing rolls 16 whereby the freshly severed uniting bands are separated from the leader of the web 13 to allow for more convenient attachment of such uniting bands to successive groups in the flutes of the transfer conveyor 12. The uniting bands are preferably attached in such a way that they extend substantially tangentially of the respective groups and that each thereof is in substantially linear contact with the entire filter plug as well as with the adjacent inner end portions of the respective plain cigarettes of unit length.

The transfer conveyor 12 delivers successive groups (each of which carries a uniting band) to a first rolling device 22 which comprises a rotary drum-shaped conveyor 58 (see FIG. 3) serving to advance the groups past a normally stationary second rolling device 23. The rolling devices 22 and 23 define a gap G (see FIG. 2) normally having a width which at most equals the diameter of a group so that, when a group advances through the gap G, it is caused to rotate about its own axis to thereby convert the corresponding uniting band into a tube which sealingly connects the filter plug to the adjacent end portions of the associated plain cigarettes of unit length. The rolling devices 22 and 23 form part of the improved apparatus. The conveyor 58 of the rolling device 22 delivers successive filter cigarettes of double unit length into successive peripheral flutes of a rotary drum-shaped drying conveyor 24 which is heated from within to complete the setting of adhesive on the convoluted uniting bands. Such setting begins in the gap G because the rolling device 22 and/or 23 (preferably the device 23) is also heated from within the promote setting of adhesive which has been applied by the paster 18.

The drying conveyor 24 delivers successive filter cigarettes of double unit length into the peripheral flutes of a rotary drum-shaped severing conveyor 26 which cooperates with a rotary disk-shaped knife 26A to sever each convoluted uniting band midway between its axial ends and to thus convert each filter cigarette of double unit length into two coaxial filter cigarettes of unit length. Each filter cigarette of unit length includes one of the plain cigarettes, one-half of the filter plug and one-half of the convoluted uniting band. Furthermore, the severing conveyor 26 serves to initiate or facilitate the ejection of defective filter cigarettes of unit length and/or double unit length, e.g., of cigarettes wherein the filter plug and/or one of the plain cigarettes is missing or of groups which are devoid of uniting bands so that they cannot be converted into filter cigarettes.

The filter plugs of pairs of filter cigarettes of unit length which are formed on the severing conveyor 26 in cooperation with the rotary knife 26A are adjacent to each other. In order to insure proper testing and/or packing of filter cigarettes of unit length, it is desirable that the filter plugs of all such cigarettes face in the same direction. Therefore, the filter tipping machine comprises a turn-around device 29 which inverts one filter cigarette of each pair end-for-end so that the filter plugs of all filter cigarettes of unit length which advance beyond the turn-around device 29 face in the same direction. The latter comprises a first rotary drum-shaped conveyor 27 whose flutes receive pairs of coaxial filter cigarettes of unit length from the severing conveyor 26. One filter cigarette of each pair is transferred into a flute of a second rotary drum-shaped conveyor 27A of the turn-around device 29 and the other filter cigarettes of successive pairs are transferred, without any inversion, into alternate peripheral flutes of a third rotary drum-shaped conveyor 28 of the device 29. The cigarettes in the flutes of the conveyor 27A are accepted by the orbiting arms 29A of the turn-around device 29 and are moved along arcs of 180 degrees to change their orientation prior to insertion into successive flutes of a fourth rotary drum-shaped conveyor 28A of the device 29. The conveyor 28A delivers inverted filter cigarettes into empty flutes of the conveyor 28 (preferably into the spaces between the non-inverted cigarettes) so that the conveyor 28 transports a single row of filter cigarettes of unit length wherein all of the filter plugs (of unit length) face in the same direction. Such filter cigarettes are transferred onto a rotary drum-shaped conveyor 31 which forms part of a testing device for monitoring the condition of wrappers of successive filter cigarettes of unit length. Filter cigarettes having effective wrappers (e.g., wrappers with large holes, open seams or frayed ends) are ejected during transport in the flutes of a rotary drum-shaped ejecting conveyor 32 which receives filter cigarettes from the conveyor 31. If desired, the conveyor 32 can form part of a further testing device which monitors the tobacco-containing ends of successive filter cigarettes of unit length and initiates the segregation of cigarettes having tobacco containing ends which are too dense or too soft. The ejecting conveyor 32 deposits satisfactory filter cigarettes of unit length onto the upper reach of a belt conveyor 36 which is trained over pulleys 34 (one shown). The illustrated pulley 34 cooperates with a braking drum 33. The filter cigarettes on the upper reach of the belt conveyor 36 are delivered to a packing machine, to storage, to a pneumatic conveyor system which shoots the cigarettes to a remote packing machine, or to a machine for temporary storage of cigarettes, e.g., a machine known a Resy and manufactured by the assignee of the present application.

As shown in FIGS. 3 and 4, the conveyor 58 of the first rolling device 22 is a hollow cylinder which is mounted on and receives torque from a drive shaft 59. The peripheral surface 38 of the conveyor 58 is formed with axially parallel group-receiving flutes 37 which are relatively shallow and flank convex panels forming part of the peripheral surface 38. The second rolling device 23 has a complementary concave rolling surface 39. The width of the gap G between the surfaces 38 and 39 is preferably slightly less than the diameter of a group of articles which are fed into the gap by the flutes of the transfer conveyor 12 when the filter tipping machine of FIG. 1 is in actual use.

FIGS. 2 and 3 further show a shifting mechanism 41 which can move the second rolling device 23 between the operative position of FIG. 2 and the inoperative position of FIG. 3. The shifting mechanism 41 is a parallel motion mechanism including two fulcra 42, 43 fixedly mounted in the frame 10 of the filter tipping machine and pivotably supporting discrete levers 44, 46. The right-hand end portions of the levers 44 and 46, as viewed in FIG. 2 or 3, are articulately connected to each other by a link 47 which carries the second rolling device 23. The lever 44 is a bell crank lever one arm of which is coupled to the link 47 and the other arm of which is articulately connected to the piston rod 48 of a double-acting pneumatic cylinder 49. The two chambers of the cylinder 49 are connectable with a source 52 of pressurized fluid (preferably compressed air) through the medium of a solenoid-operated 4/2-way valve 51 of any suitable design.

The positions of the shiftable rolling block 23 are monitored by two signal generators here shown as proximity detector switches 53 and 54. The switch 53 transmits a signal when the rolling device 23 is held in the operative position of FIG. 2, and the switch 54 transmits a signal when the rolling device 23 is held in the inoperative position of FIG. 3. As mentioned above, the width of the gap G is increased at least slightly beyond its normal width when the rolling device 23 is shifted to the inoperative position of FIG. 3. In such inoperative position of the rolling device 23, a group of several coaxial rod-shaped articles which is delivered by the transfer conveyor 12 cannot be caused to rotate about its own axis because the width of the gap between the rolling devices 22 and 23 exceeds the diameter of the group.

FIG. 2 further shows an additional signal generator or sensor 56 which constitutes a jam detector and is located at the inlet of the gap G. This detector is displaced by groups of coaxial rod-shaped articles which cannot enter the gap G (for example, because a previously supplied group adheres to the surface 38 or 39 as a result of deposition of adhesive on such surface) to thereby actuate a proximity detector switch 57. Thus, the switch 57 transmits a "defect" signal when the transfer conveyor 12 (i.e., the means for feeding groups of coaxial articles) supplies groups at a time when such groups are incapable of advancing through the gap G and of being converted into filter cigarettes of double unit length.

The conveyor 58 constitutes the rotary outer constituent of the first rolling device 22. This rolling device further comprises a stationary inner constituent or core having a hollow cylindrical inner section 61 (see FIGS. 3 and 4) which spacedly surrounds the drive shaft 59 for the cylindrical conveyor 58, and a hollow cylindrical outer section 62 which spacedly surrounds the section 61. The internal space or suction chamber 61A of the section 61 is connected with a suction generating device (not shown), e.g., with a fan. The cylindrical shell of the section 61 has one or more bores 63 which can establish communication between the space 61A and the internal space 62A of the section 62. The section 62 has slots 64 which communicate with suction ports 66 machined into the cylindrical conveyor 58 and extending inwardly from the flutes 37. Thus, when the bores 63 are free to establish communication between the internal spaces 61A and 62A, the aforementioned suction generating device can draw air into the ports 66 to thus insure that a group of coaxial articles which has been transferred into a flute 37 remains in such flute during travel with the conveyor 58 from the transfer station between the conveyors 12, 58 to the transfer station between the conveyor 58 and 24. The end wall 62B of the outer section 62 of the stationary core of the first rolling device 22 is further formed with bores 67 which can connect the space 62A with the atmosphere.

The first rolling device 22 further comprises a flanged hollow cylindrical valving element 68 which serves to control the flow of air between the spaces 61A, 62A as well as between the space 62A and the atmosphere. To this end, the cylindrical portion of the valving element 68 has one or more bores 69 which can be moved into or out of register with the bores 63 of the inner section 61. The flange 68A of the valving element 68 has bores 71 which can be moved into and out of register with the bores 67 in the end wall 62B of the section 62. The valving element 68 surrounds and is rotatable on the inner section 61 of the core of the first rolling device 22.

The means for changing the angular position of the valving element 68 to thereby regulate the flow of air between the spaces 61A, 62A as well as between the space 62A and the atmosphere includes a double-acting pneumatic cylinder 72 having a piston rod 73 which is articulately coupled to an eyelet 68E of the valving element 68. The two chambers of the cylinder 72 are connected with conduits 74, 76 which, in turn, are connected to conduits 77, 78. The conduits 77, 78 connect the chambers of the double-acting cylinder 49 with the valve 51. The conduit 76 contains a solenoid-operated 2/2-way shutoff valve 79.

The means for cleaning the rolling surface 38 and/or the complementary surface 39 comprises a cleaning implement in the form of a brush 81. The body 81A of the brush 81 carries two sets of bristles 81B and 81D, namely, a set of bristles 81B at one side of the brush body to clean the surface 38 and a set of bristles 81D at the opposite side of the brush body to clean the surface 39 when the brush 81 is introduced into the widened gap G and is moved back and forth substantially in the axial direction of the conveyor 58. The means for moving the brush 81 relative to the surfaces 38, 39 between a first position shown in FIG. 3 (namely, in or beyond the widened gap G) and a second position in which the brush 81 is retracted comprises a mechanism certain details of which are illustrated in FIGS. 4 to 7. The brush 81 is mounted at the free end of one arm of a two-armed bell crank lever 82. The two arms of the lever 82 are tubes 84 (see FIG. 6) and make an angle of 90 degrees. The lever 82 is pivotable about the axis 83 of a stationary shaft 87. The free end of that arm 84 of the lever 82 which is remote from the brush 81 carries a sleeve 86 which is screwed, bolted or otherwise affixed to the shaft 87. The latter is turnable in a bearing member 88 which is secured to the frame 10 of the filter tipping machine. The median portion of the lever 82 (namely, the portion where the arms 84 meet) carries a pivot pin 89 for a joint 91 which articulately connects the lever 82 with the piston rod 92 of a double-acting pneumatic cylinder 93. The latter serves to pivot the lever 82 and to thereby move the brush 81 relative to the rolling devices 22 and 23. That end portion of the cylinder 93 which is remote from the pivot pin 89 carries a fixed pivot member 94. Thus, the cylinder 93 can turn about the axis of the pivot member 94 and its piston rod 92 can pivot the lever 82 about the axis 83 of the shaft 87. The chambers of the cylinder 93 are connected with conduits 96, 97 which can connect the respective chambers with a source of pressurized fluid (preferably compressed air) or with the atmosphere through the medium of a 4/2-way regulating valve 98. The positions of the brush 81 are monitored by two proximity detector switches 99 and 101. The switch 99 transmits a signal when the brush 81 is held in the solid-line position, and the switch 101 transmits a signal when the brush is moved to the broken line position of FIG. 4.

Figure 8:
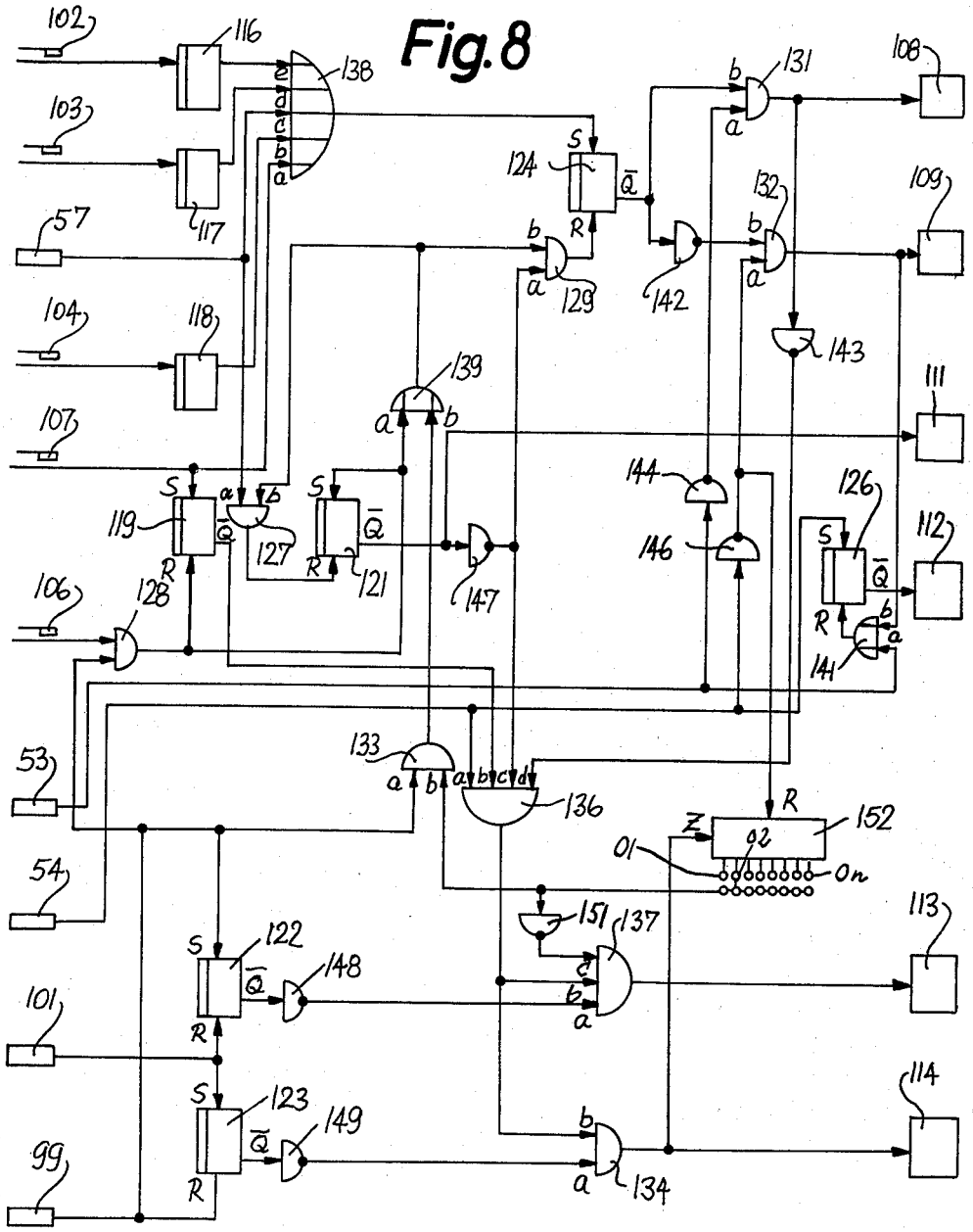
FIG. 8 is a circuit diagram of the control system of the improved convoluting apparatus.

FIG. 8 illustrates the electrical control system of the improved apparatus. This control system includes the aforementioned signal generators (proximity detector switches) including the jam detector 56 and its switch 57, the switches 53, 54 which respectively monitor the operative and inoperative positions of the shiftable rolling device 23, and the switches 99, 101 which monitor the positions of the brush 81. Still further, the circuit of FIG. 8 includes a signal generator 102 constituting an arresting switch for the prime mover PM of the filter tipping machine, a signal generator 103 which constitutes a starter switch for the prime mover PM, and a signal generator in the form of a switch 104 which can be actuated by an attendant whenever desired or necessary in order to initiate a cleaning action, i.e., to withdraw the rolling device 23 and to thereupon start the movement of the brush 81 relative to the surfaces 38 and 39. Still further, the circuit of FIG. 8 comprises a switch 106 which can be actuated by an attendant to shift the rolling device 23 to inoperative position without starting the means for moving the brush 81, and a switch 107 which can be actuated to return the rolling device 23 to operative position while the mechanism for moving the brush 81 remains idle.

The blocks in the right-hand portion of FIG. 8 denote two actuators 108, 109 for the valve 51. The actuator 108 is operated by an attendant to cause the valve 51 to move (via cylinder 49 and piston rod 48) the rolling device 23 to the operative position of FIG. 2, and the actuator 109 is operated to cause the valve 51 to move the rolling device 23 to the inoperative position of FIG. 3. An actuator 111 is operable to stop the entire filter tipping machine, and a further actuator 112 can be operated to open the shutoff valve 79. Still further, the control circuit of FIG. 8 comprises two actuators 113, 114 for the valve 98. The actuator 113 causes the valve 98 to initiate the movement of the brush 81 to the solid-line position of FIG. 4, and the actuator 114 can initiate the movement of the brush 81 to the broken-line position of FIG. 4.

Still further, the control circuit of FIG. 8 comprises a plurality of components which connect the aforementioned signal generators and actuators to each other. Such components include three differentiators 116, 117, and 118 of the type known as monoflops. A characteristic feature of monoflops is that their outputs transmit signals of short duration or signals whose duration is or can be limited in response to the application of signals to their inputs. Thus, the duration of output signals is not a function of the duration of input signals. The components further include six signal storing circuits 119, 121, 122, 123, 124, 126 (hereinafter called storages) each of which has a setting input S, a resetting input R and an output Q. The construction of storages 119 . . . 126 is such that the output Q does not transmit a signal when the input S receives a signal but no signal is applied to the input R. The output Q transmits a signal when the input R receives a signal irrespective of whether the input S receives or does not receive a signal. The condition at the output W does not change when no signals are transmitted to the inputs S and R.

The aforementioned components of the control circuit of FIG. 8 further include nine AND gates 127, 128, 129, 131, 132, 133, 134, 136, 137; three OR gates 138, 139, 141; eight inventers 142, 143, 144, 146, 147, 148, 149, 141; and a counter 152 having a resetting input R, a counting input Z and several outputs 01, 02 . . . 0n.

The operation of the improved apparatus including the brush 81 is as follows:

It is assumed that the rolling surface 38 and/or 39 is contaminated by adhesive which has been withdrawn from the tank of the paster 18 and transported to the rolling device 22 and/or 23 by groups of rod-shaped articles (more particularly, by uniting bands which are attached to groups on the transfer conveyor 12). When the contamination of the surface 38 and/or 39 reaches a certain stage, the groups which are fed by the transfer conveyor 12 begin to pile up at the inlet of the gap G (whose width is normal because the shiftable rolling device 23 is held in the operative position of FIG. 2) and interfere with orderly advancement of groups through the gap and on toward the drying conveyor 24. The piled-up groups actuate the jam detector 56 which causes the proximity detector switch 57 to transmit a "defect" or "malfunction" signal. As shown in FIG. 8, the "defect" signal is transmitted to the input d of the OR gate 138 and thence to the input S of the storage 124. No signal is applied to the input R of the storage 124 by the AND gate 129 so that the output Q of the storage 124 does not transmit a signal to the inverter 142. Therefore, the output of the inverter 142 transmits a signal to the input b of the AND gate 132. The input a of the AND gate 132 also receives a signal because the proximity detector switch 54 does not transmit a signal (the rolling device 23 is held in the operative position of FIG. 2) to the input of the inverter 146 and, therefore, the output of the inverter 146 transmits a signal to the input a of the AND gate 132. The output of the AND gate 132 transmits a signal to the actuator 109 which causes the valving element of the valve 51 to move from the position of FIG. 2 to the position of FIG. 3. Consequently, the left-hand chamber of the cylinder 49 is connected to the atmosphere via conduit 78 and valve 51, and the right-hand chamber of the cylinder 49 is connected to the source 52 of compressed gas via valve 51 and conduit 77. The piston rod 48 is retracted into the cylinder 49 and the lever 44 retracts the link 47 so that the rolling device 23 is moved away from the rolling device 22 and the width of the gap G increases.

The signal which appears at the output of the AND gate 132 is further transmitted to the input R of the storage 126 via OR gate 141. Therefore, the output Q of the storage 126 transmits a signal to the actuator 112 for the shutoff valve 79. The valve 79 opens (i.e., its valving element assumes the position which is shown in FIG. 3) so that the upper chamber of the cylinder 72 receives compressed gas from the source 52 via valve 51 and conduits 74, 77. At the same time, the lower chamber of the cylinder 72 communicates with the atmosphere via shutoff valve 79, conduits 76, 78 and valve 51. The piston rod 73 of the cylinder 72 maintains the valving element 68 in an angular position in which the bores 63 are sealed from the space 62A and the bores 67 communicate with the bores 71, i.e., the ports 66 are sealed from the space 61A (and hence from the suction generating device) and communicate with the atmosphere. Consequently, the groups which are fed by the transfer conveyor 12 to the flutes 37 of the conveyor 58 cannot be retained in the flutes 37 and descend by gravity into a collecting receptacle or onto a suitable conveyor, not shown.

When the second rolling device 23 completes its movement to the inoperative position of FIG. 3, it causes the proximity detector switch 54 to transmit a signal to the input S of the storage 126. The transmission of a signal to the input R of the storage 126 is already interrupted for the following reasons: The input a of the OR gate 141 does not receive a signal from the proximity detector switch 53 because the latter transmits a signal only as long as the second rolling device 23 remains in the operative position of FIG. 2. The input b of the OR gate 141 does not receive a signal because the jam detector 56 is free to return to its normal position and, therefore, the proximity detector switch 57 does not transmit a signal to the OR gate 141 via OR gate 138, storage 124, inverter 142 and AND gate 132. The signal at the output Q of the storage 126 disappears and the actuator 112 ceases to maintain the valving element of the shutoff valve 79 in the position of FIG. 3. Thus, the valve 79 seals the conduit 76 and interrupts the communication between the lower chamber of the cylinder 72 and the atmosphere.

The signal which is generated by the proximity detector switch 54 is applied to the input R of the counter 152 via inverter 146 (whose output does not transmit a signal when its input receives a signal from the switch 54) so that the counter 152 is reset to zero. Still further, the signal which is generated by the proximity detector switch 54 on movement of the second rolling device 23 to the inoperative position of FIG. 3 is transmitted to the input a of the AND gate 136 whose output then transmits a signal because the inputs b, c and d of the AND gate 136 also receive signals. The signal which is transmitted by the output of the AND gate 136 is applied to the input b of the AND gate 137. The input c of the AND gate 137 receives a signal because the input of the inverter 151 does not receive a signal (and therefore, the output of the inverter 151 transmits a signal to the input c of the AND gate 137), and the input a of the AND gate 137 receives a signal from the inverter 148 because the input of this inverter does not receive a signal from the output Q of the storage 122. The output Q of the storage 122 does not transmit a signal because its input S receives a signal from the proximity detector switch 99 (brush 81 in the solid-line position of FIG. 4) but the input R does not receive a signal from the proximity detector switch 101 (the latter is not actuated because the brush 81 is held in the position which is shown in FIG. 4 by solid lines). The signal at the output of the AND gate 137 is transmitted to the actuator 113 for the regulating valve 98 which admits compressed fluid into the conduit 97 and hence into the right-hand chamber of the cylinder 93. The piston rod 92 pivots the lever 82 in a direction to move the brush 81 from the solid-line position to the broken-line position of FIG. 4. The prime mover PM is on and drives the shaft 59 so that the conveyor 58 of the rolling device 22 rotates while the brush 81 moves along the full length of the cylinder 58 and cleans the surface 38 simultaneously with the surface 39. As explained hereinabove, the brush 81 has two sets of bristles, namely, a set of bristles 81B for the surface 38 and a set of bristles 81D for the surface 39. The dimensions of the brush 81 are such that, when the rolling device 23 is shifted to inoperative position of FIG. 3, the brush 81 has sufficient room to move in substantial parallelism with the axis of the rotating conveyor 58 and to move its bristles into engagement with and along the surfaces 38, 39.

The proximity detector switch 101 transmits a signal when the brush 81 reaches the end position which is shown in FIG. 4 by broken lines, and such signal is applied to the input S of the storage 123. The input R of the stroage 123 does not receive a signal because the proximity detector switch 99 ceases to transmit a signal when the brush 81 leaves the solid-line position of FIG. 4. Therefore, the output Q of the storage 123 does not transmit a signal but the input a of the AND gate 134 receives a signal owing to the provision of the inverter 149. The input b of the AND gate 134 also receives a signal because the output of the AND gate 136 transmits a signal thereto. This is due to the fact that the inverter 143 transmits a signal to the input d of the AND gate 136 (because the input of the inverter 143 does not receive a signal owing to disappearance of the "defect" signal which was generated by the proximity detector switch 57 as long as the groups of articles were piled up at the inlet to the gap G. The signal which is transmitted by the output of the AND gate 134 is applied to the actuator 114 which causes the valve 98 to admit compressed fluid to the left-hand chamber of the cylinder 93 so that the brush 81 is moved back to the solid-line position of FIG. 4 and its bristles subject the surfaces 38, 39 to a renewed cleaning action. The signal which is transmitted by the output of the AND gate 134 is further applied to the input Z of the counter 152 so that the just described cleaning operation upon the surfaces 38 and 39 is repeated, i.e., the brush 81 moves from the solid-line to the broken-line position of FIG. 4 and thereupon back to the solid-line position. In other words, the counter 152 is adjusted in such a way that it causes two consecutive movements of the brush 81 between the two end positions which are shown in FIG. 4.

Since the counter 152 is set for two consecutive cleaning operations by the brush 81, its corresponding (second) output 02 transmits a signal to the inverter 151 not later than when the brush 81 completes the second of its return movements to the solid-line position of FIG. 4. Therefore, the signal at the input c of the AND gate 137 disappears and the output of the AND gate 137 ceases to transmit a signal to the actuator 113. In other words, the brush 81 remains idle after it completes its second movement back to the solid-line position of FIG. 4.

The signal which is transmitted by the output 02 of the counter 152 is further transmitted to the input b of the AND gate 133 whose input a also receives a signal as soon as the brush 81 returns to its normal position and causes the proximity detector switch 99 to transmit a signal. The output of the AND gate 133 transmits a positive signal to the input R of the storage 124 via OR gate 139 and AND gate 129. The input S of the storage 124 ceases to receive a signal as soon as the pileup at the inlet to the gap G disappears. The output Q of the storage 124 transmits a signal to the input b of the AND gate 131. The input a of the AND gate 131 also receives a signal due to the presence of inverter 144 whose output transmits a signal because its input does not receive a signal from the proximity detector switch 53 (the rolling device 23 is still held in the inoperative position of FIG. 3). The output of the AND gate 131 transmits a signal to the actuator 108 which initiates the return movement of rolling device 23 to the operative position of FIG. 2, i.e., the width of the gap G is reduced to its normal value so that the groups which enter the gap thereafter are compelled to roll about their respective axes during movement toward and beyond the discharge end of the gap. Return movement of the rolling device 23 to its operative position is effected by the valve 51 which connects the source 52 with the conduit 78 and connects the conduit 77 with the atmosphere, i.e, the piston rod 48 is caused to move in a direction to the right, as viewed in FIG. 2 or 3. When the rolling device 23 completes its movement to the operative position of FIG. 2, it causes the proximity detector switch 53 to transmit a signal to the input a of the OR gate 141 so that the output of the OR gate 141 transmits a signal to the input R of the storage 126. There is no signal at the input S of the storage 126 because the proximity detector switch 54 is inactive. The output Q of the storage 126 transmits a signal to the actuator 112 which causes the valving element of the shutoff valve 79 to reassume the position which is shown in FIG. 3. Thus, the cylinder 73 is caused to move the piston rod 72 in a direction to rotate the valving element 68 in order to seal the space 62A from the atmosphere (by the flange 68A) and to establish communication between the spaces 61A and 62A so that the ports 66 communicate with the space 61A and attract the oncoming groups to the surfaces surrounding the respective flutes 37 of the conveyor 58. In other words, the valving element 68 seals the bores 67 from the atmosphere and allows air to flow from the ports 66 into the bores 63.

If the proximity detector switch 57 continue to transmit a "defect" signal upon completion of two forward and return strokes of the brush 81 (i.e., upon repeated cleaning of the surfaces 38 and 39), the control circuit of FIG. 8 causes the actuator 111 to transmit a signal which initiates stoppage of the entire filter tipping machine. The actuator 111 receives the signal from the switch 57 via AND gate 127 and storage 121.

If an attendant so desires, the brush 81 can be caused to move along and to clean the surfaces 38 and 39 independently of the position of the jam detector 56. The attendant merely actuates the switch 104 whereby the circuit 118 transmits a signal to the input a of the OR gate 138 to initiate the movement of rolling device 23 to inoperative position and subsequent movement of the brush 81 between the solid-line and broken-line positions of FIG. 4. The manner in which the cleaning operation proceeds is the same as described above in connection with the generation of a "defect" signal by the proximity detector switch 57, i.e., in response to displacement of the jam detector 56 by a pile of groups at the inlet to the gap G.

In the event that the malfunctions or disturbances are attributable to reasons other than a pileup at the gap G, the attendant can initiate a movement of the rolling device 23 to inoperative position by actuating the switch 106. When the cause of malfunction is eliminated, the rolling device 23 is returned to the operative position upon actuation of the switch 107. The manner in which such movements of the rolling device 23 are effected in response to actuation of switches 106 and 107 will be readily understood by referring to FIG. 8. The just described movements of the rolling device 23 to inoperative position (switch 106) and back to operative position (switch 107) take place without initiating a movement of the brush 81 from the solid-line position of FIG. 4, i.e., the brush 81 remains idle so that the attendant can gain access to the surfaces 38 and 39 in view of widening of the gap G. The shaft 59 continues to rotate the conveyor 58 (i.e., the prime mover PM is on) so that the attendant can use an implement other than the brush 81 to clean the surface 38 and/or 39.

The surfaces 38 and 39 are cleaned automatically in response to starting or stoppage of the prime mover PM. Cleaning in response to starting of the prime mover PM is initiated by the starter switch 103, and cleaning during running out of the prime mover is initiated by the arresting switch 102.

An important advantage of the improved convoluting apparatus with its cleaning brush 81 is that the surface 38 and/or 39 can be cleaned automatically, not only when the need for cleaning has already arisen (i.e., in response to the generation of a "defect" signal by the proximity detector switch 57) but also when the cleaning of such surface or surfaces constitutes a mere precautionary measure (namely, when the brush 81 cleans the rolling device 22 and/or 23 in automatic response to starting or stoppage of the filter tipping machine or in response to actuation of the switch 104 at the will of an attendant). Such preventive or precautionary cleaning is desireable because it greatly reduces the likelihood of large accumulations of dried and caked adhesive on the surface 38 and/or 39, i.e., of such accumulations whose removal necessitates prolonged interruptions of operation of the filter tipping machine. Prolonged interruptions of operation are especially undesirable when the filter tipping machine forms part of a production line which further includes one or more cigarette makers, one or more machines for the production of filter rod sections, and one or more packing machines.

Automatic cleaning of the surfaces 38 and 39 on starting of the prime mover PM is desirable and advantageous in order to insure that there will be no pileup of groups at the inlet to the gap G as soon as the machine is started. In other words, the brush 81 removes dried adhesive paste from the conveyor 58 and/or rolling device 23 practically immediately after the conveyor 58 begins to rotate with the shaft 59 (which is driven by the prime mover PM) to thus insure that a certain (relatively long) interval of time will elapse before the surface 38 and/or 39 is contaminated by adhesive (deposited by) successive or certain uniting bands) to such an extent that the jam detector 56 initiates a cleaning operation by causing the rolling device 23 to move to the position of FIG. 3 and by thereupon causing the brush 81 to move along the surfaces 38 and 39 as often as desired, i.e., as often as selected by adjustment of the counter 152. Another reason for starting the operation of the filter tipping machine simultaneously with a more or less thorough cleaning of the surfaces 38 and 39 is that, when the brush 81 moves between the two positions which are shown in FIG. 4, the ports 66 of the conveyor 58 are sealed from the suction chamber or space 61A so that the initially assembled groups are not permitted to advance into and beyond the gap G. This is often desirable or even necessary because the filter cigarettes which are produced immediately after starting of the filter tipping machine are likely to be defective for a variety of reasons which are known to persons having the requisite skill in this art. For example, adhesive which was applied to the web 13 prior to stoppage of the machine is likely to be dry in the region between the paster 18 and the drum 19 so that the corresponding uniting bands are not likely to bond plain cigarettes to the filter plugs.

Automatic cleaning of the surfaces 38 and 39 on actuation of the arresting switch 102 for the prime mover PM is also desirable and advantageous in order to avoid excessive drying of adhesive which accumulates on the rolling device 22 and/or 23. This facilitates the task of the brush 81 during cleaning which immediately follows actuation of the starter switch 103. Thus, the likelihood of excessive accumulations of adhesive on the surface 38 and/or 39 at the time the prime mover PM is started again is greatly reduced if the brush 81 performs a final cleaning action just before the conveyor 58 comes to a full stop.

The purpose of the switch 104 is to enable an attendant to initiate a cleaning action irrespective of the presence or absence of deposits of adhesive on the surface 38 and/or 39. This is a preventive measure which is carried out by an experienced attendant who is familiar with the operation of the filter tipping machine and sets the brush 81 in motion at intervals which are necessary or desirable to prevent substantial accumulation of adhesive on the one and/or the other rolling device. Timely actuation of the manually operated switch 104 can insure that the jam detector 56 is not displaced at all, i.e., that the surfaces 38 and 39 are cleaned before they accumulate such quantities of wet, partly dried and/or fully dried adhesive that the groups which are fed by the transfer conveyor 12 are likely to pile up at the inlet to the gap G. If desired, the switch 104 can serve the sole purpose of moving the rolling device 23 away from the rolling device 22 so that the attendant can inspect the surfaces 38, 39 and/or resort to an implement other than the brush 81 in order to remove accumulations of adhesive and/or other contaminants.

Accurate synchronization of the operation of means for shifting the rolling device 23 to the inoperative position of FIG. 3 and means (valving element 68) for sealing the suction ports 66 from the space 61A when the brush 81 is to perform one or more working strokes is desirable and advantageous in order to insure that the groups of coaxial articles which are delivered by the transfer conveyor 12 cannot interfere with the cleaning operation of the brush. The cleaning operation of this brush is especially effective upon the surface 38 because the conveyor 58 rotates while the brush 81 moves back and forth between the two end positions which are shown in FIG. 4. The flexibility, length, material and/or other characteristics of the two sets of bristles 81B and 81D on the body 81A of the brush 81 will be selected in dependency on the nature of adhesive, in dependency on the material of the rolling devices 22 and 23, in dependency on the desired extent of cleaning action and/or in dependency on certain other parameters to insure an optimum cleaning action. Instead of pivoting the brush 81 between its two end positions, the mechanism which moves the brush can be designed to reciprocate the brush in exact parallelism with the axis of the conveyor 58. Also, the mechanism which moves the brush 81 can be designed to rotate the brush in order to further enhance the cleaning action, especially upon the concave surface 39 of the shiftable rolling device 23. The tips of the bristles on the body of the brush 81 are preferably located in two planes one of which is convex (see the bristles 81D) to complement the concave surface 39 and the other of which is concave (see the bristles 81B) to complement the convex surface 38. This also contributes to a more reliable cleaning action.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. Apparatus for convoluting adhesive-coated uniting bands around groups of coaxial rod-shaped articles in filter tipping and analogous machines, comprising first and second rolling devices defining a gap having a width which normally at most equals the diameters of the articles, said first device including a conveyor and means for driving said conveyor, and one of said devices being shiftable with reference to the other of said devices between an operative position in which said devices define said gap and an inoperative position in which the width of said gap is increased; means for feeding groups of rod-shaped articles and attached uniting bands into said gap in the operative position of said one device so that the groups are transported by said conveyor through said gap and are caused to rotate about their respective axes to thereby convert the corresponding uniting bands into tubes; means for shifting said one device between said positions; and a cleaning implement movable between a plurality of positions intermediate said devices to clean at least one of said devices when said one device is shifted to said inoperative position.

2. The apparatus of claim 1, further comprising means for actuating said shifting means, said actuating means including at least one signal generator.

3. The apparatus of claim 2, wherein said signal generator includes a jam detector adjacent to said gap.

4. The apparatus of claim 2, further comprising prime mover means for said driving means, said signal generator including means for starting said prime mover means.

5. The apparatus of claim 2, further comprising prime mover means for said driving means, said signal generator including means for arresting said prime mover means.

6. The apparatus of claim 2, wherein said signal generator includes a device which is actuatable by and at the will of the attendant.

7. The apparatus of claim 1, wherein said conveyor is a rotary conveyor and includes axially parallel peripheral receiving means for groups of coaxial articles.

8. The apparatus of claim 7, wherein said rotary conveyor includes means for holding groups of articles in said receiving means by suction.

9. The apparatus of claim 8, further comprising means for deactivating said holding means in response to movement of said one rolling device to said inoperative position.

10. The apparatus of claim 8, wherein said holding means includes suction ports in said conveyor, said suction ports communicating with said receiving means and further comprising a suction chamber normally communicating with said ports and means for sealing said chamber from said ports in response to movement of said one rolling device to said inoperative position.

11. The apparatus of claim 1, wherein said cleaning implement comprises at least one brush.

12. The apparatus of claim 11, wherein said brush comprises a first set of bristles which are movable along said first rolling device and a second set of bristles which are movable along said second rolling device in the inoperative position of said one rolling device.

13. The apparatus of claim 11, wherein said first rolling device has a convex surface adjacent to said gap and said second rolling device has a concave surface adjacent to said gap, said first and second sets of bristles being respectively movable along said first and second surfaces.

14. The apparatus of claim 13, wherein the tips of said first set of bristles are located in a first plane which is complementary to said first surface and the tips of said second set of bristles are located in a second plane which is complementary to said second surface.

15. The apparatus of claim 1, further comprising means for moving said cleaning implement relative to said rolling device in the inoperative position of said one rolling device.

16. The apparatus of claim 15, wherein said moving means includes means for moving said cleaning implement in substantial parallelism with the axis of said conveyor.

17. The apparatus of claim 16, wherein said conveyor is a rotary cylinder having a first and a second end, as considered in the axial direction thereof, and said moving means includes means for moving said cleaning implement between a first end position at one end and a second end position at the other end of said cylinder.

18. The apparatus of claim 1, further comprising means for applying adhesive to uniting bands ahead of said rolling devices so that the uniting bands which move through said gap are likely to deposit adhesive on said first and/or second rolling device.

19. The apparatus of claim 1, further comprising means for moving said cleaning implement along said rolling devices in the inoperative position of said one rolling device and means for selecting the duration of movement of said cleaning implement relative to said rolling devices.

* * * * *